US006487841B1

(12) United States Patent
Dalitz et al.

(10) Patent No.: US 6,487,841 B1
(45) Date of Patent: Dec. 3, 2002

(54) RING SPINNING FRAME WITH CLAMPING DEVICE AT THE SPINDLE

(75) Inventors: Dieter Dalitz, Büsingen (CH); Martin Dübendorfer, Rickenbach (CH); Stephan Fichtner, Andelfingen (CH); Richard Kummer, Winterthur (CH); Angelo Lucca, Seuzach (CH); Henry Ott, Winterthur (CH); Andreas Rieche, Winterthur (CH); Thomas Schwab, Seuzach (CH); Peter Christen, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 09/665,461

(22) Filed: Sep. 19, 2000

(30) Foreign Application Priority Data

Sep. 20, 1999 (DE) ..... 199 45 043

(51) Int. Cl.[7] ..... D01H 7/52
(52) U.S. Cl. ..... 57/75
(58) Field of Search ..... 57/66, 67, 68, 57/70, 71, 72, 73, 74, 75, 76, 77, 313, 315, 92, 119, 136, 362

(56) References Cited

FOREIGN PATENT DOCUMENTS

| | | | |
|---|---|---|---|
| DE | 19803036 A1 | * | 7/1999 |
| EP | 0462467 A1 | | 12/1991 |
| EP | 0528752 A1 | | 2/1993 |
| EP | 0480357 B1 | | 4/1995 |

OTHER PUBLICATIONS

German Search Report, Feb. 2, 2000.

* cited by examiner

*Primary Examiner*—Danny Worrell
*Assistant Examiner*—Shaun R Hurley
(74) *Attorney, Agent, or Firm*—Dority & Manning

(57) ABSTRACT

A method for controlling a ring spinning frame that has a drafting unit, a spindle, and a ring rail is provided. The method involves providing a clamping device for yarn in a position below a cop on the spindle. The method further involves the driving of the drafting unit, the spindle, and the ring rail in coordinated operation. Also included is changing the twisting of the yarn in order to obtain a matched strength during formation of the reverse winding at the end of the winding cop before reaching the cop bottom port within the last phase of the downward movement of the ring rail. Additionally, the yarn is brought into a section of the clamping device, and the spinning frame is slowed to a standstill. A spinning frame is also provided.

29 Claims, 2 Drawing Sheets

RING SPINNING FRAME WITH CLAMPING DEVICE AT THE SPINDLE

BACKGROUND

A spinning frame of this type is known from the European patent EP 0 462 467. The clamping device below the cop at the spindle enables it to operate with a comparatively short length of yarn for the underwinding. It is the aim to operate with an underwinding yarn length (clamping length) corresponding with a partial loop of the spindle at the height of the underwinding crown or the clamping device respectively. In order to reach this target it is necessary to determine the wound yarn length as exactly as possible. The supply quantity of yarn from the drafting unit is measured starting from the point of time at which the ring rail with the traveler has laid the yarn at a height below the upper edge of the underwinding crown. Such a device is described in detail in the European patent EP 0 528 752. The objects of the two mentioned European patents are thus considered as an integrated part of the invention being described hereafter.

From the European patent 0 480 357 it is known to control the number of revolutions of the spindles or of the drafting unit respectively individually, during the spinning out process, where however the particular problem of the underwinding with a clamping device is not being considered.

In ring spinning frames according to the known art, which are provided with electromotive drives for a fast lowering of the ring rail, the ring rail is basically moved downward at constant speed for the formation of the reverse winding. In a ring spinning frame of the present type, with a clamping device for the yarn in the underwinding position, the individual operating parameters have to be adapted to one another more exactly than in today's conventional spinning frames. It may be necessary to specifically influence the yarn characteristics, especially during the last phase of the spin out, in order to assure an operation without disturbances. These are requirements to be met with the present invention.

SUMMARY OF THE INVENTION

Objects and advantages of the invention will be set forth in part in the following description, or may be obvious from the description, or may be learned from practice of the invention.

According to the invention, a spinning frame with a drafting unit, a spindle and a ring rail are provided. The drafting unit, the spindle and the ring rail are kept in coordinated operation via the respective drives, and with a clamping device for the yarn in a position below the cop on the spindle. During the formation of the reverse winding, when the yarn is led from the uppermost position on the cop into the position below the cop to the clamping device, the individual components of the drafting unit drive and of the spindle drive are being driven. They are driven in such a way that before the lower part of the cop is reached, within the second phase of the downward movement of the ring rail, the twist of the yarn is specifically being altered in order to achieve a higher strength. This occurs before the yarn is brought into the section of the clamping device and the spinning frame is decelerated to a standstill. The ring rail remains only during approximately two revolutions of the spindle in the lowest position at the clamping device, preferably however only as long until the yarn has been laid over half, up to three quarters of the circumferential length within the winding zone.

During the downward movement of the ring rail, the supply speed in the drafting unit and the number of revolutions of the spindle are being reduced in such a coordinated way that the desired yarn twist and the yarn count is at first maintained and the yarn course on the cops becomes rather steep. However, a change in yarn count can also be advantageous. After depositing the underwinding the ring rail is again lifted up from the lowest position into the position above the clamping device, whereafter first the drafting unit and then the spindle drive or both at the same time are brought to a standstill. After formation of the underwinding, the drafting unit can still be kept in operation for a short period of time in order to further supply a yam length which is additionally required because of a deflection of the yarn below the drafting unit due to the upward tilting of the yarn guide. On the other hand, during a fast downward movement of the ring rail and when at the same time the reverse winding is being laid, no yarn curlings may form due to low yarn tensions within the yam section between the drafting unit and the traveller. Here, yarn tensions may not exceed a permissible value.

The spindle drive, the ring rail drive and the drafting unit drive are linked with a control unit. The control unit comprises besides the power section a memory, an input unit and a data processor. In the data processor, operating programs for the different drives are stored. Program modules for the single drives may be provided in the control unit. Further, an input device pertains to the control unit and a memory for the entered textile technological data.

Above the clamping device, shiftable along the spindle, an underwinding crown or a cutting ring respectively, is fixedly attached to the spindle. The arrangement is made in such a way that in the clamping position for the yarn, the clamping device rests on the underwinding crown. The clamping device is pressed upwards by a spring from the lower part of the spindle and by means of a separate actuating device. Alternatively, it is pressed directly by the ring rail. During its movement, the clamping device can be shifted into the lowest downward position, that is into the opening position.

The indications for direction relate to the schematic illustration in FIG. 2. The indications for directions are not absolute but are chosen from the viewpoint of the observer. Textile technological data is entered into the input unit, such as the twist of the yarn, the mass of the cop, the cop diameter, the length of the sleeve and the ring diameter. Furthermore, maximum deceleration values for the spindle and maximal values for the ring rail speed during the downward movement within the last phase can be defined. With the help of the data processor, the operating programs for the drafting unit drive, the spindle drive and the ring rail drive are then calculated or stored in the memory respectively. Advantageously, also stored is the desired altered yarn characteristics during the last phase of the spin out.

Depending on the yarn to be produced, different parameters result for the calculation of the operating programs which can be stored as data sets in the memory. The control unit calculates the data of the operating program in a way that due to the observation of the textile technological boundary values, during the last phase of cop formation, as few thread breaks as possible occur. This happens during doffing or cop exchange respectively, and during the start of newly spinning of a cop.

Due to the clamping of the yarn below the cop, when an additional need of thread length arises, the traveller on the ring of the ring rail cannot be turned backward. Therefore, it is important that the drafting unit still supplies an additional yarn length after the yarn is already blocked in the clamping device. With this arrangement, an unthreading of the yarn from the traveller is practically impossible. While the reverse winding is performed on the cop, the deceleration of the number of revolutions of the spindle occurs with a delay value of preferably between 15 and 25 $1/S^2$. If the yarn count is also to be maintained during this last phase of cop formation, then due to the yarn count and the yarn twist, the drafting unit deceleration has to be calculated depending on the delay in the spindle drive. The ring rail speed in consequence is to be adapted to the supply speed of the yarn, so that the yarn supply during winding of the reverse winding is just sufficient.

Besides a calculation of the operating program for the drafting unit and the ring rail, single values for the supply quantity of the yarn from the drafting unit and the lifting height of the ring rail in dependence on the numbers of revolutions on the spindle can be determined experimentally. Depending on yarn count, a ring rail speed of between 30 and 120 mm/sec is preferred. The first value stands for a fine yarn count and the second for course yarns. It is also advantageous to alter the yarn count starting at least from the point of time of performing the reverse winding in a way that a favourable condition results for inserting the yarn into the clamping device.

Figure 1:
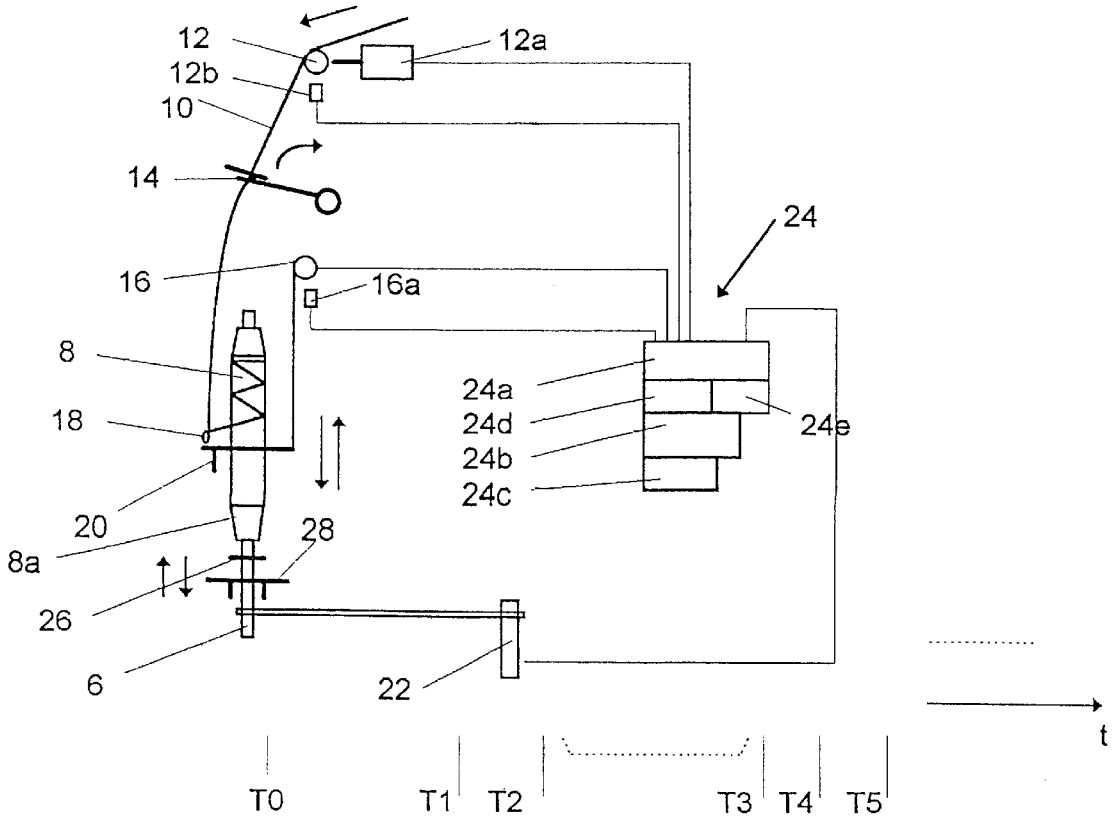
FIG. 1: a diagram in which the number of revolutions of the spindle N (1/min), the supply L (m/min) from the drafting unit and the ring rail stroke H (m) are listed.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

After completion of the cop 8, it is possible that within its upper part an upper winding exists. During lowering of the ring rail 20, the reverse winding and finally the underwinding below the cop is laid onto the spindle 6. At this point, the so called doffing, i.e. the removal of the cop or of a number of cops respectively, takes place in the spinning frame. The phase starting with the reverse winding is considered to be critical since during transition from the normal spinning operation to the standstill of the machine, before the doffing and before the following start of the spinning frame, most of the thread breaks or disturbances respectively can occur. These include such things as the unthreading of the yarn 10 from the traveller 18. Also, during a fast reduction of the number of revolutions of the spindle N, which occurs during the last phase of the cop travel, the thread balloon which forms between a thread guide 14 and the traveller 18 around the cop 8 has the tendency to collapse at the loss of tension. This is because the centrifugal force on the yarn is declining. This has to be compensated for by reducing the supply L from the drafting unit 12 and at the same time by a suitable downward movement of the ring rail.

It has been recognized that at the beginning of the formation of the reverse winding (starting from the point of time T0) the ring rail has to be moved downward fast according to FIG. 1. However, the movement has to be decelerated again in order to avoid excess tensioning in the yarn 10. The movement of the ring rail in the first phase of the reverse winding between the point of time T0 and T1 is thus characterized by a fast downward acceleration of the ring rail 20 followed by a deceleration. As soon as the ring rail 20 with the traveller 18 and the yarn 10 are located within the section of the lower part of the cop 8*a*, it is suitable to increase the lowering speed of the ring rail 20 again. This is so that the yarn is led as steep as possible along the circumference of the cop 8 or of the bottom part of the cop 8*a* respectively, down to an underwinding crown 26. Preferably, the value of the angle of the yarn along the circumference of the cop 8*a* should not fall below 45° in relation to a horizontal line. Thus it is assured that the yarn 10 at the point of time T2 is positioned precisely at the outer rim of the underwinding crown 26 which is toothed, and thus the tendency for gliding along the underwinding crown during further rotation of the spindle 6 is avoided.

The ring rail remains below the underwinding crown only for a short period of time between T2 and T3. During this period the clamping device 28 is positioned next to the double arrow in FIG. 2 in a position away from the underwinding crown 26. The lower part of the ring rail rests on the clamping device 28, which by the force of a spring from below, can be shifted along the spindle shaft of the spindle 6. It is assumed that at the point of time T2, the clamping device 28 begins to move away from the underwinding crown 26 and that at the point of time T3 it rests again on it. By this process, the yarn 10 is clamped between the underwinding crown 26 and the clamping device 28 so that a relatively short piece of yarn, called underwinding or length of clamping yarn, suffices to ensure a secure holding and a precise yarn rupture at the height of the underwinding crown 26 during the succeeding doffing, i.e. the removal of the cop.

The underwinding length is preferably shorter than a circumferential length on the spindle 6 below the underwinding crown 26. On one side of the underwinding, the yarn 10 breaks during the removal of the cop 8 on the other side the connection with the yarn 10 leading through the traveler 18 upwards through the yarn guide 14 up to the drafting unit stays intact. After replacing a new empty sleeve on the spindle 6 the spinning process can then start again. From FIG. 1 it can be seen that after the point of time T3 still a finite yarn supply L takes place up to the point of time T4. This so called excess length is required in order to provide an additional length within the course of the yarn guidance between the drafting unit 12 and the traveler 18 on a spinning ring at the ring rail 20. This is required when the yarn guide 14 according to the arrow 14 is swung upwards before the doffing process. Furthermore from FIG. 1, it can be seen that the spindle at the point of time T4 of the supply stop can still be rotated up to the point of time T5 whereby the yarn 10 receives a higher twist than during the normal spinning process. The excess twist can be of advantage since the yarn during the next critical phase of the start of the spinning process is exposed to a higher tension than during the regular spinning process.

According to the invention, from a certain point of time on, for instance T1 according to FIG. 1 or still before the point of time T0, when the reverse winding is not being carried out, the twist (corresponding with the torsion coefficient $\alpha$) is changed. This is done in such a way that within the section of the clamping crown or underwinding crown 26, favourable conditions result for inserting;, clamping or tearing of the yarn during doffing of the cop. For instance, if a yarn is to be produced with the torsion coefficient α' it can be favourable to increase the twist to α" or to decrease it so that the breaking load B reaches its most favourable value for the stopping and the following of the spinning frame. Furthermore, for a disturbance-free insertion of the yarn below the underwinding crown and the removal of the cop, whereby a yarn rupture occurs, it can be preferable to alter the supply of the drafting unit in such a way that a yarn of a different count results. It is to be aimed to increase the yarn count, that is to reduce the cross section during or shortly before underwinding, to make the yarn more smooth whereby less disturbances result before, during and after the underwinding. During the following re-winding of the yarn in the winding machine, the concerned yarn part is then removed automatically so that the changed yarn structure has no negative effect in the succeeding processes.

Figure 2:
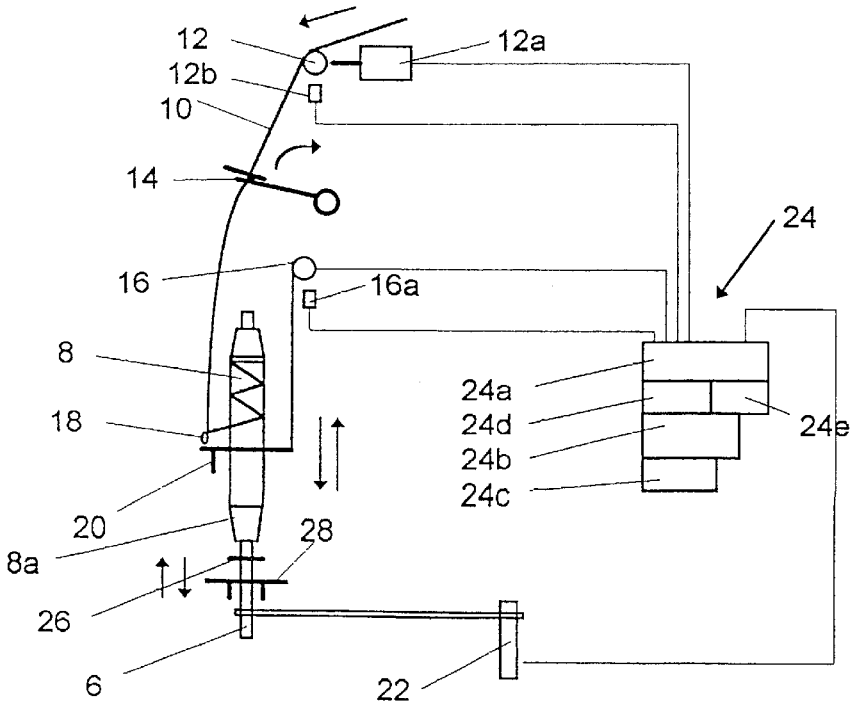
FIG. 2: a schematic illustration of a spinning unit of the spinning frame.
Figure 3:
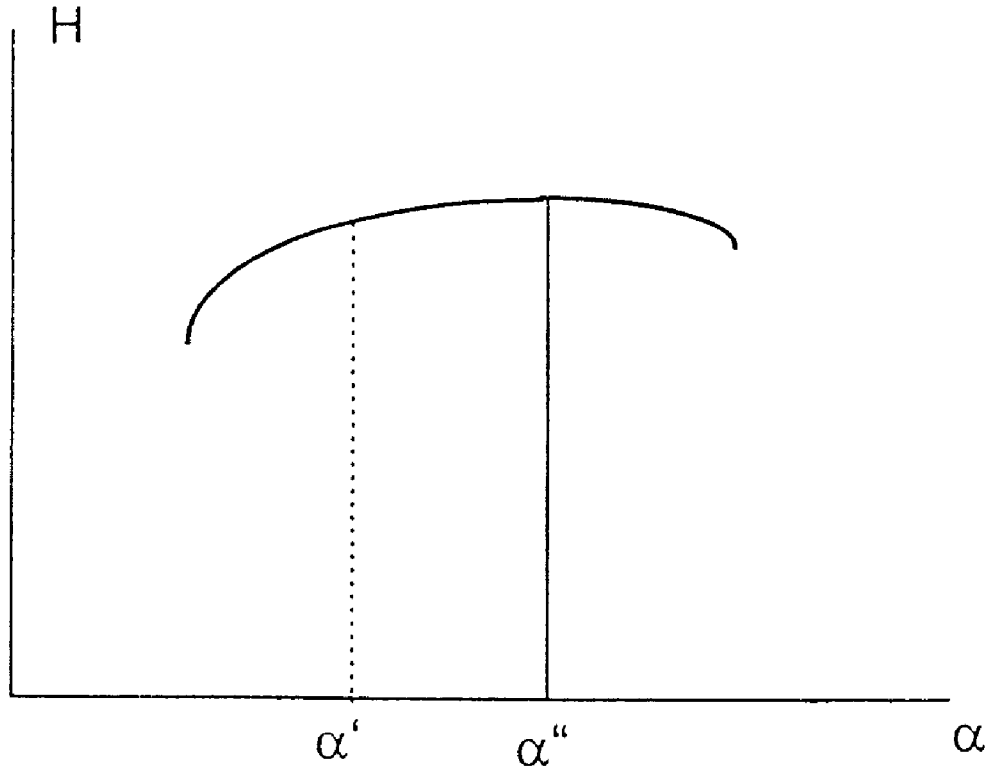
FIG. 3: a diagram with the dependence of the yarn strength H from the torsion coefficient $\alpha$.

For the coordinated movement of the ring rail 20, the spindle 6 and the rollers in the drafting unit 12, the respective drives such as the drafting unit drive 12*a*, the ring rail drive 16 and the spindle drive 22 as illustrated in FIG. 2 are connected to a control unit 24. Unit 24 comprises a power section 24*a*, a memory 24*b* and an input unit 24*c*. Further, a data processor 24*d* is provided in order to determine the motion program, amongst other things, for the spindle 6, the drafting unit 12 and the movement of the ring rail 20. Preferably, a calculating program is loaded into the data processor 24*d*, which based on the input value, calculates the optimal laws of motion. These values include: the lengths of sleeve HL, the diameter of the spinning ring D, the number of reverse windings HW, the clamping length, that is the underwinding length of the yarn 10 UW and the supplemental length ZL supplied between the points of time T3 and T4, and the torsion coefficient a. Preferably a deceleration value of above 15 $1/sec^2$ for slowing down the spindle drive 22 is preset. When calculating the ring rail speed, a dependence prevails from the supply L so that during formation of the reverse winding the yarn is not excessively elongated or relaxed. The yarn supply starting from the point of time T0, according to FIG. 1, is the yarn length for the reverse winding, for the underwinding and the supplemental length, the latter between the points of time T3 and T4. The supply L for the yarn is calculated on the base of the preset function N=f(t) with the mentioned deceleration value and the torsion coefficient α, where the conditions $[T/m=\alpha_m * \sqrt{(Nm)}=N/L]$ is to be met. Here, T=number of revolutions m=unit of length $a_m$=torsion coefficient Nm=yarn count N=number of revolutions of the spindle in revolutions per minute r.p.m.

L=supply in meters per minute

It is also possible to set course of the supply L above the time and calculate the number of revolutions N accordingly. During the production of a specific yarn whose characteristics regarding the underwinding cannot be determined in advance, it is suitable to lay out the control unit 24. This is done in such a way that in deviation to the theoretically calculated number of revolutions N of the spindle above the time, the operation is performed with a reduced n umber of revolutions N (t). This is done so that the spindles come to a standstill after completion of the underwinding. This occurs at the same time with the drafting unit or only slightly later (i.e. by one second later at a maximum). Thus jamming of the traveller with the ring is prevented which could be the case if the spindles were rotating too long after the stop of supply from the drafting unit. More favorable conditions are also provided for at the succeeding restart of the spinning frame when immediately after switching on of the spindles, the travellers continue to rotate.

The control unit 24 is preferably laid out in such a way that the spindles prior to the actual switching on of the spinning frame are rotated forward by a fraction of one revolution or several revolutions. This starts with a gradual acceleration up to the operating speed, the movement of the ring rail and the start-up of the drafting unit so that the travellers can be freed from a possible unfavourable jammed position. Depending on the material to be processed in the spinning frame, the mode of this advanced rotation of the spindles should be selectable between an on and off position. In particular when applying so called T-flange spinning rings, it is advantageous to control the spindles 6 in such a way that they come to a standstill in the position of the upper ring side on the ring rail 20 at the height of the underwinding crown.

When influencing the yarn twist in such a sense that an optimal yarn strength results during the reverse winding or at least during the underwinding respectively, for knit yarn an additional twist is imparted, while on the other hand for crêpe yarn the yarn twist is reduced. When producing effect yarn, for example flame or knop yarn, it is suitable to keep the number of revolutions of the drafting unit 12 or the supply respectively constant starting from the beginning of the reverse winding or at the latest with the beginning of the underwinding. This is done so that during this phase of the spin out process, smooth yarn without effects results. Thus, a higher operation reliability is achieved since the underwinding and the following tearing off of the yarn during cop change for the desired yarn strength can be achieved: If a so called flame or a thick part were present within the section of the underwinding of the yarn, or before or after said section, then the yarn could break at this point during the cop change or doffing respectively and not at the planned point where the reverse winding part contacts the clamping crown below the cop. By switching off the effect control for the reason of the change of the number of revolutions in the drafting unit, a collapse of the balloon during the spin out can also be avoided. The subpression of the effect control of the yarn can be realized in a simple manner in that within the control unit 24 especially for the drafting unit drive 12*a*, a frequency threshold is determined. Below this frequency no flames are produced.

By means of a potential free contact, the flame effect can be switched on or off respectively. In the memory 24*b* or by means of the input unit 24*c* calculating parameters can be retrieved or entered respectively, to effect within the data processor 24*d* that a variation of the number of revolutions in the drafting unit 12 during the reverse winding is subpressed.

According to FIG. 2, an impulse generator 12*b* may be arranged on the drafting unit drive 12*a*, preferably on the outlet roller of the drafting unit 12. A rotary inducer 16*a* on the ring rail drive 16 may also be placed. Each of which is connected to the control unit 24. Based on the impulses of the impulse generator 12*b*, which in correspondence to the yarn supply are being transmitted to the data processor 24*d*, the ring rail speed can be calculated continuously if there are no pre-calculated operating programs being stored within the memory 24*b*. The impulse generator 16*a* shown laid out as an absolute value transducer, enables the determination of the point of time at which, after passing the underwinding crown, the yarn is to be laid at underwinding. This is done so that starting from this point of time, the supply length of the yarn during the formation of the underwinding can be exactly determined by the rotary generator 12*b*. A comparator 24*e* of the control unit 24, in which the pre-set values form the memory 24*b* and the actual values from the distance transducers 12*b* and 16*a* are being compared, triggers switching conditions within the power section for the drafting unit drive 12*a* or the ring rail drive.

In a module of the memory 24*b*, laws of motion are stored for the acceleration process and the deceleration process of the ring rail drive. These can be retrieved from the data processor 24*d* depending on the signals for the rotary generator 16*a*.

The ring rail drive 16 is controlled in such a way that the ring rail 20 remains in the lowest position during a maximum of two loops around the spindle 6 by the yarn within the section of the underwinding, preferably only during ¾ loops. The number of revolutions of the spindle during the formation of the reverse winding is decreased in such a way that the number of revolutions of the spindle at the beginning of the formation of the underwinding amounts to 6,000 revolutions per minute at the most. As long as the ring rail 20 remains in the lowest position during the underwinding, the spindle 6 rotates at less then 1,000 revolutions. The underwinding yarn length is wound onto the circumference of the spindle, preferably in an amount less then 100 mm.

The lowering speed of the ring rail 20 during the formation of the reverse winding, that is between the uppermost position on the spindle 6 and the lowest position, is chosen in relation to the supply from the drafting unit 12 and to the number of revolutions of the spindle 6. This is done in such a way that the yarn 10 is led steeply downward, and amounts to between 0.5 and 3 loops on the cop. The inclination of the yarn 10 is kept constant as far as possible.

The twist a of the yarn is changed specifically in order to achieve an adapted strength. This occurs during the formation of the reverse winding at the end of the winding of a cop before the lower part of the cop is reached within the last phase of the downward movement of the ring rail 20. This occurs before the yarn is brought into the section of the clamping device 28 and before the spinning frame is decelerated down to the standstill.

Starting from the point of the formation of a reverse winding, the twist and/or draft and the number of revolutions are changed. This is done to control a spinning frame with a drafting unit 12, spindles 6, ring rail 20 and with a clamping device 28 for the yarn 10 in a position below a cop 8. This change occurs in such a way that in comparison to the normal spinning process adapted, i.e. higher or lower strength properties or characteristics respectively, of the yarn result within the section of the reverse winding or underwinding. Thus the operating reliability of the spinning frame is increased, in particular in that unwanted thread breaks are avoided or in that desired thread breaks are obtained.

It should be understood that the invention includes various modifications that can be made to the embodiments of the ring spinning frame with clamping device at the spindle described herein as come within the scope of the appended claims and their equivalents.

What is claimed is:

1. A method for controlling a ring spinning frame having a drafting unit, a spindle, and a ring rail with respective drives, the drives kept in coordinated operation by a control unit, said method comprising the steps of:

providing a clamping device for yarn in a position below a cop on the spindle;

forming a reverse winding of yarn at the end of winding of the cop before reaching a bottom part of the cop with a last phase of downward movement of the ring rail;

bringing the yarn to the clamping device below the cop while slowing the spinning frame to a standstill; and during said forming of a reverse winding, changing twisting of the yarn in order to achieve a different yarn strength before the yarn is held by the clamping device.

2. The method of claim 1, further comprising the step of increasing the number of revolutions of input rollers or output rollers of the drafting unit in order to obtain a higher amount of drafting for presented fiber material during said forming of a reverse winding.

3. The method of claim 1, further comprising the step of forming an underwinding of yarn at an underwinding crown below the cop during movement of the ring rail to its lowermost position.

4. The method of claim 3, wherein said forming an underwinding of yarn comprises moving the ring rail past the underwinding crown and directly against the clamping device so that the clamping device shifts away from the underwinding crown, forming the underwinding between the underwinding crown and the clamping device, and moving the ring rail upwards so that the clamping device clamps the underwinding against the underwinding crown.

5. The method according to claim 3, further comprising the steps of controlling the spindles so that the spindles come to a standstill in the position of the ring rail at the height of the underwinding crown; and moving the ring rail into a cop doffing position.

6. The method of claim 1, wherein said step of changing the twist of the yarn comprises adjusting the twist to achieve a desired breaking load of the yarn.

7. The method of claim 1 further comprising the step of changing the supply of the drafting unit during production of the reverse winding in order to produce a finer count yarn.

8. The method of claim 1 further comprising the step of maintaining the condition $[T/m=\alpha_m*\sqrt{(Nm)}=N/L]$ during at least the formation of the reverse winding, wherein:

T=number of turns per meter, m=unit of length, $\alpha_m$=torsion coefficient,

Nm=yarn count,

N=turns of the spindle in revolutions per minute, and

L=supply in meters per minute.

9. The method of claim 1, further comprising the step of operating the control unit during the formation of the reverse winding in order to have the spindle come to a standstill at most one second later than the drafting unit.

10. The method according to claim 1, further comprising the step of adding a supplemental twist to the yarn during formation of the reverse winding when producing knitting yarns.

11. The method according to claim 1, further comprising the step of reducing the twist of the yarn during the formation of the reverse winding when producing crêpe yarns.

12. The method according to claim 1, further comprising the step of maintaining a constant number of revolutions of the drafting unit during formation of the reverse winding when producing effect, flame, and knop yarns so that a smooth yarn without effects results.

13. The method according to claim 12, further comprising the step of determining a frequency threshold for the control unit below which flame, knop, and other effects cannot be generated.

14. The method according to claim 1, further comprising the step of suppressing speed variations by use of a data processor unit in the control unit at least during the formation of the reverse winding.

15. The method according to claim 1, further comprising the step of maintaining the ring rail in its lowermost position at the clamping device for a time being no more than two loops of the spindle.

16. The method according to claim 1, further comprising the step of varying the lowering speed of the ring rail after completion of the cop in relation to the number of revolutions of the spindle in order to position between 0.5 and 5 reverse windings on the cop.

17. The method according to claim 1, further comprising the step of lifting the ring rail from the lowest position to above the clamping device before the drafting unit and the spindle come to a standstill.

18. The method according to claim 1, further comprising the step of stopping the spindle at or after stopping of the drafting unit drive.

19. The method according to claim 1 further comprising the steps of:

measuring the position of the ring rail by a distance transducer;

programming a control unit to determine the lowest position of the ring rail within a section of the clamping device;

measuring the yarn supply within the drafting unit by a distance transducer; and interrupting the supply of yarn if a desired yarn length is wound as underwinding at the clamping device on the circumference of the spindle.

20. The method according to claim 1, further comprising, during said forming of a reverse winding, changing the yarn count while the yarn is led from a top position on the cop; and influencing the drafting unit in order to obtain a finer yarn count.

21. A spinning frame comprising:

a drafting unit driven by a drafting unit drive for delivering yarn;

a spindle driven by a spindle drive;

a ring rail driven by a ring rail drive, the ring rail located between the drafting unit and the spindle;

a clamping device for the yarn located proximate to the spindle;

a cop located proximate to the ring rail; and a control unit linking the drafting unit drive, the spindle drive, and the ring rail drive, the control unit having a power section, the control unit configured to control the drafting unit drive to obtain a modified amount of draft at the end of the cop travel during the braking process of the drafting unit drive and of the spindle drive.

22. The spinning frame of claim 21, wherein the number of revolutions of the drafting unit drive and the spindle drive are adjusted with respect to one another in order to produce a yarn having a higher strength with a changed twist.

23. The spinning frame of claim 21, wherein the control unit further comprises a memory, an input unit, and a data processor.

24. The spinning frame of claim 21, wherein the clamping device is shiftable along the spindle, and further comprising an underwinding crown fixedly fastened onto the spindle, wherein in a clamping position for the yarn the clamping device rests on the underwinding crown.

25. The spinning frame of claim 21, wherein the clamping device on the side opposite the ring rail is spring loaded in the longitudinal direction of the spindle.

26. The spinning frame of claim 21, wherein the control unit has a memory for storing parameters of the spinning frame including:

twist of the yarn, the cop mass, the ring diameter, the cop diameter, sleeve length, and the yarn count, the control unit also having a data processor for storing driving programs for the drafting unit drive, the spindle drive, and the ring rail drive.

27. The spinning frame of claim 21, further comprising:

a distance transducer on the ring rail drive, the distance transducer linked to the control unit; and a distance transducer on the drafting unit drive, the distance transducer linked to the control unit, wherein the control unit has a data processor, a memory, and a comparator in order to make comparisons of the stored values in the memory to the measured values of the position of the ring rail and the supply of the drafting unit and in order to initiate switching conditions at an agreement of the values by which the drafting unit drive, the ring rail drive, and the spindle drive can be switched.

28. The spinning frame of claim 1, wherein the control unit has a memory module having motion laws for the process of acceleration and deceleration of the ring rail drive, the motion laws retrievable based on signals from a distance transducer on the ring rail drive.

29. A method for controlling a ring spinning frame having a drafting unit, a spindle, and a ring rail with respective drives, the drives controlled by a control unit. Said method comprising the steps of:

providing a clamping device for a yarn in a position below a cop on the spindle;

forming a reverse winding of yarn during a last phase of downward movement of the ring rail;

bringing the yarn to the clamping device below a cop on the spindle while breaking the spinning frame to a standstill; and during said forming of the reverse winding, changing at least one of the parameters of twist, draft, and number of revolutions of the cop in such a way that a different yarn strength of the yarn is defined in the reverse winding section of the yarn as compared to the yarn produced during normal spinning of the spinning frame.

* * * * *